US005238033A

United States Patent [19]

Bald

[11] Patent Number: 5,238,033

[45] Date of Patent: Aug. 24, 1993

[54] APPARATUS FOR COLLECTING LIQUID LEAKAGE

[76] Inventor: Erwin Bald, Berliner Allee 100, 5680 Iserlohn-Letmathe, Fed. Rep. of Germany

[21] Appl. No.: 994,440

[22] Filed: Dec. 21, 1992

Related U.S. Application Data

[63] Continuation of Ser. No. 707,569, May 30, 1991, abandoned.

[30] Foreign Application Priority Data

May 31, 1990 [DE] Fed. Rep. of Germany ..... 4017534
Aug. 16, 1990 [DE] Fed. Rep. of Germany ..... 4025839

[51] Int. Cl.[5] ..... B65B 1/04

[52] U.S. Cl. ..... 141/86; 191/114; 222/108; 383/33

[58] Field of Search ..... 141/86, 88, 114; 222/108; 220/731, 565, 368; 383/33, 67, 118

[56] References Cited

U.S. PATENT DOCUMENTS

| | | | |
|---|---|---|---|
| 4,278,115 | 7/1981 | Briles | 141/86 |
| 4,501,305 | 2/1985 | Zola et al. | 141/86 |
| 4,520,852 | 6/1985 | Klein | 141/86 |
| 4,579,155 | 4/1986 | Zola | 141/86 |
| 4,659,251 | 4/1987 | Petter et al. . | |
| 4,809,866 | 3/1989 | Crocker | 141/86 |

*Primary Examiner*—Ernest G. Cusick
*Attorney, Agent, or Firm*—Anderson Kill Olick & Oshinsky

[57] ABSTRACT

Apparatus for collecting liquid leakage when the liquid is supplied to an underground storage tank holding fuel, heating oil and the like, includes a liquid leakage resistant flexible recovery bag (13) located around and sealed to a filling pipe (4) extending into the tank (1). The recovery bag (13) is positioned within a dome pit (10) and is located between the dome lid (3) and a cover (12) on the dome pit (10).

16 Claims, 6 Drawing Sheets

APPARATUS FOR COLLECTING LIQUID LEAKAGE

This is a continuation of application Ser. No. 07/707,569, filed May 30, 1991, now abandoned.

BACKGROUND OF THE INVENTION

The present invention is directed to an apparatus for collecting liquid leakage in the region of a filling pipe located within a dome pit where the pipe discharges through a dome cover into an underground storage tank for fuel, heating oil and the like.

In the past, the storage of fuels has resulted in considerable environmental damage, especially with the initial use of single wall tanks. Such tanks develop leakage after a relatively short period of use because of rust. More recently the problem with single wall tanks has been relieved by utilizing double wall tanks. The routine overfilling of the tanks has also been prevented by regulations requiring overfilling safety devices or limit value indicators.

After the introduction of the above mentioned safety means, the most frequent and unpleasant damage experienced in underground tanks results from spillage or leakage. When the filling hose located in a transport vehicle is detached from the filling tube fixed to the tank in the ground, a residual quantity of liquid escapes from the filling hose and such liquid leakage, especially fuel or heating oil, is mixed with water almost always present in the dome pit. The water seeps into the dome pit through the pit sidewalls during rainfall or when it is raining or when snow melts the water enters the dome pit through the pit cover located at the surface of the ground in which the tank is located. As a result, after filling the tank and detaching the filling hose, the liquid spilled combines with the water located in the pit and is more or less rapidly transported by diffusion into the ground water. Seepage into the ground or the ground water often causes environmental damage, such as ground water contamination, and the removal of such contamination involves extraordinarily high costs. Ground water contamination can be increased by the liquid leakage or seepage flowing over the external insulation of the tank, whereby apart from damaging the insulation and possible causing rust damage to the tank outer wall, other noxious material from the insulation may enter the ground water.

SUMMARY OF THE INVENTION

Therefore, it is the primary object of the present invention to provide a solution which prevents as completely as possible all leakage or spillage damages as mentioned above.

In accordance with the present invention, leakage into the ground is avoided by placing a liquid leakage resistant flexible recovery sack or bag surrounding the filling pipe in a liquid type manner between the dome lid on the tank and the lid or cover on the dome pit.

In such apparatus, when the filling hose is detached from the filling pipe fixed to the tank, any residual quantity of the liquid can not enter the ground through the dome pit, rather it is collected in the recovery bag and, after a certain height of the liquid in the bag is reached, it can be emptied by a small pump available at filling stations or it can be emptied directly into the storage tank.

In a particularly simple and effective embodiment the recovery bag laterally encloses the filling pipe and with the use of packing extending around the pipe upwardly from the tank and using a clamping device, such as a hose clamp, at the upper end of the packing, a liquid tight connection can be provided.

A standpipe may also be located in the tank and the recovery bag can be sealed to it in a manner similar to the seal about the filling pipe, whereby a vertically dip stick in the standpipe may cause leakage when the dip stick is used, so that the tank contents may be spilled over the top of the standpipe and flow into the recovery bag.

In a particularly advantageous embodiment, the packing surrounds the filling pipe and possibly the stand pipe in a bellows-like manner, and in such an arrangement the hose clamp can be positioned as high as possible in the recovery bag at the filling pipe, so that none of the liquid can escape between the packing and the filling pipe and penetrate into the ground water in the event the seal between the packing and the filling pipe is not completely tight for some unforeseen reason.

Furthermore, the apparatus can be arranged so that the upper ends of the filling pipe and possibly the standpipe terminate below the upper edge of the recovery bag, whereby when the filling hose is detached from the filling pipe, the liquid can not flow into the dome pit over the upper edge of the recovery bag.

Moreover, it is advantageous if the upper edge of the recovery bag is secured to the sidewalls of the dome pit so that the upper edge is spaced inwardly from the side walls for preventing rain or melted snow from flowing into the bag after passing about the pit cover. Instead, the rain or melted snow can pass along the dome pit sidewall away from the upper edge of the recovery bag and can not enter into the bag, whereby the liquid leakage in the bag is free of any contamination or dirt and can be used by pumping it out of the bag.

The upper edge of the recovery bag can be supported in adjustable hook-shaped supports, so that the entire bag can be lifted upwardly with a corresponding expansion of the bellows-like packing and then placed over a side of the pit for exposing the space above the dome cover of the tank for inspection and maintenance without first detaching the seal packing from the filling pipe.

The adjustable supports can be arranged in an especially advantageous manner on vertical rods secured at their lower ends to the dome lid, avoiding subsequent possibly difficult attachment to the dome pit walls.

Another feature of the invention is to arrange a limit value transmitter in the recovery bag whereby when a previously specified filling level in the bag is reached, the flow of the filling liquid is interrupted in the filling hose connected to the filling pipe for avoiding overfilling the bag with a resultant pollution of the surrounding ground.

It is especially useful to connect the limit value transmitter in the bag in parallel with an existing limit value transmitter inserted through the dome lid into the storage tank, so that the liquid flow through the filling hose is interrupted when a predetermined filling level in the storage tank as well as in the recovery bag is reached. Such an arrangement assures, if there is a leaky connection of the filling hose to the filling pipe with a resultant rapid filling of the recovery bag, that the leakage at the connection between the filling hose and the filling pipe can be quickly eliminated.

Moreover, it is advantageous to provide an outlet at the lowermost end of the recovery bag to facilitate emptying of the bag.

It is very advantageous to connect the outlet directly into the filling pipe above the dome lid, so that overflow of the bag is prevented, unless a larger quantity of the liquid enters into the recovery bag between the filling hose and filling pipe than can be directed through the outlet into the filling pipe and finally into the storage tank.

In another embodiment, the outlet from the recovery bag is connected to a special disposal container where another limit value transmitter can be arranged for indicating a predetermined liquid level in the container.

It is also possible to use a simple drainage faucet at the outlet to carry out individual waste disposal operations by means of an aspiration hose or the like.

In still another embodiment a leakage resistant cover can be placed on the recovery bag especially when the liquid leakage collecting in the recovery bag is immediately directed into the storage tank. With such an arrangement contamination of the liquid leakage in the recovery bag is prevented, such as by rain water.

Finally, it has been found to be advantageous to provide a recovery bag formed at least at its inner surface with a liquid leakage resistant material, preferably a rubber like material with an embedded or external reinforcement layer, such as fiberglass.

The various features of novelty which characterize the invention are pointed out with particularity in the claims annexed to and forming a part of this disclosure. For a better understanding of the invention, its operating advantages and specific objects attained by its use, reference should be had to the accompanying drawings and descriptive matter in which there are illustrated and described preferred embodiments of the invention.

DETAILED DESCRIPTION OF THE INVENTION

Figure 1:
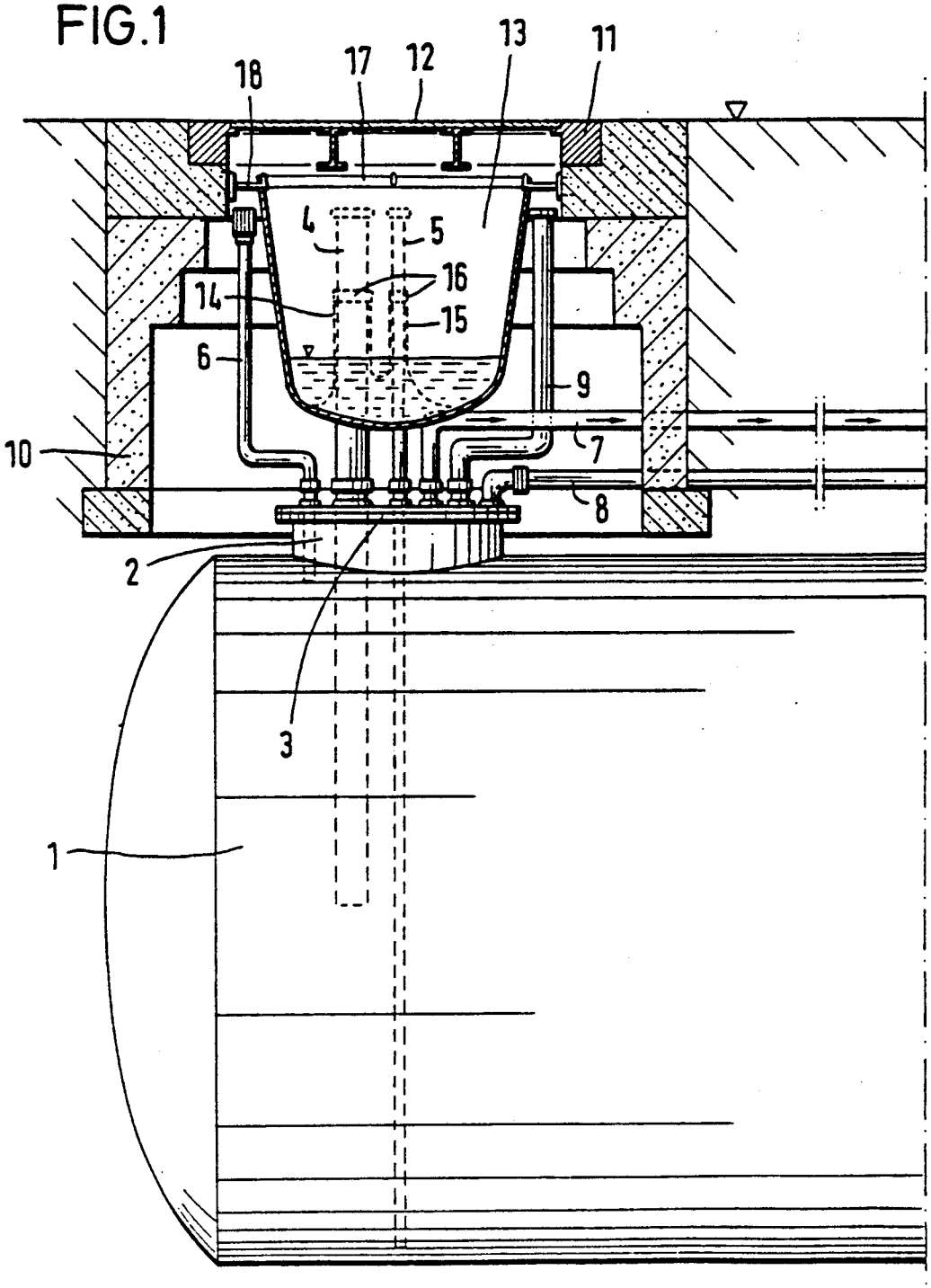
FIG. 1 is a vertical section through a recovery bag positioned in a dome pit above an underground tank and embodying the present invention.
Figure 2:
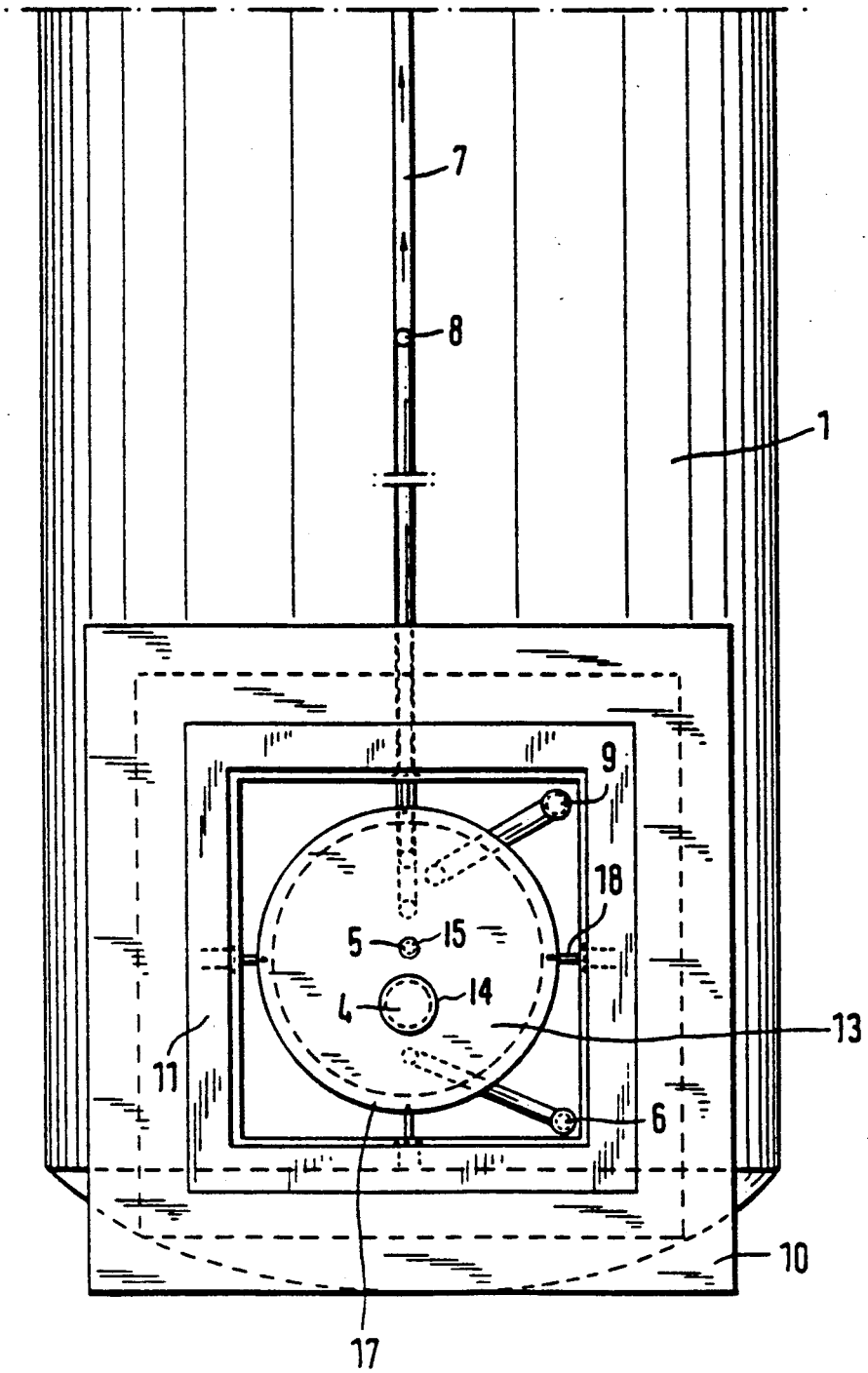
FIG. 2 is a plan view of the apparatus shown in FIG. 1.

In the apparatus illustrated in FIGS. 1 and 2, a double wall underground fuel tank 1 has a filling dome 2 closed by a dome lid 3. A filling pipe 4, a standpipe 5 equipped with a mechanical dip stick, and a limit value transmitter 6 extend downwardly through the dome lid into the tank. A fuel line 7 leading to fuel dispensing pumps, not shown, a vent 8 and a so-called gas compensation pipe 9 are connected to the dome lid.

A dome pit 10 formed of masonry or concrete is located above the filling dome 2 and has a top pit frame 11 supporting a pit cover 12. The frame 11 and cover 12 are aligned with the surrounding ground level.

With the exception of the filling pipe 4 and the standpipe 5, the other lines connected to the dome lid 3 are bent horizontally a short distance above the lid, so that a free space extends between the dome lid 3 and the pit cover 12 containing the filling pipe 4 and the standpipe 5. In this space a liquid leakage resistant flexible recovery bag 13 is located and packing 14 and 15 is arranged in a bellows-like manner extending upwardly from the base of the bag and the packing is fixed in a sealed manner to the filling pipe 4 and the standpipe 5 by hose clamps 16 or the like, note FIG. 1. In addition, the recovery bag and packing are reinforced by the hose clamp.

Recovery bag 13 is open at its upper end and has an attachment edge 17 formed by a metal ring fastened in a belt-like manner in loops of the recovery bag or molded into the edge. The recovery bag 13 can be suspended by the metal ring in hook-like adjustable supports 18. The supports 18 are fastened on the pit walls and the hook-like features opens upwardly. As shown in FIG. 2, the dome pit 10 and its pit frame 11 is square in horizontal section, while the recovery bag is circular and, as a result, there is an adequate spacing between the pit frame 11 and the attachment edge 17 of the recovery bag 13, whereby rain or melting snow seeping in around the pit frame 11 does not flow into the recovery bag, instead it seeps into the ground between the recovery bag and the pit walls. Furthermore, as shown in FIG. 1, the upper ends of the filling pipe 4 and the standpipe 5 terminate below the upper edge 17 of the recovery bag 13.

Figure 3:
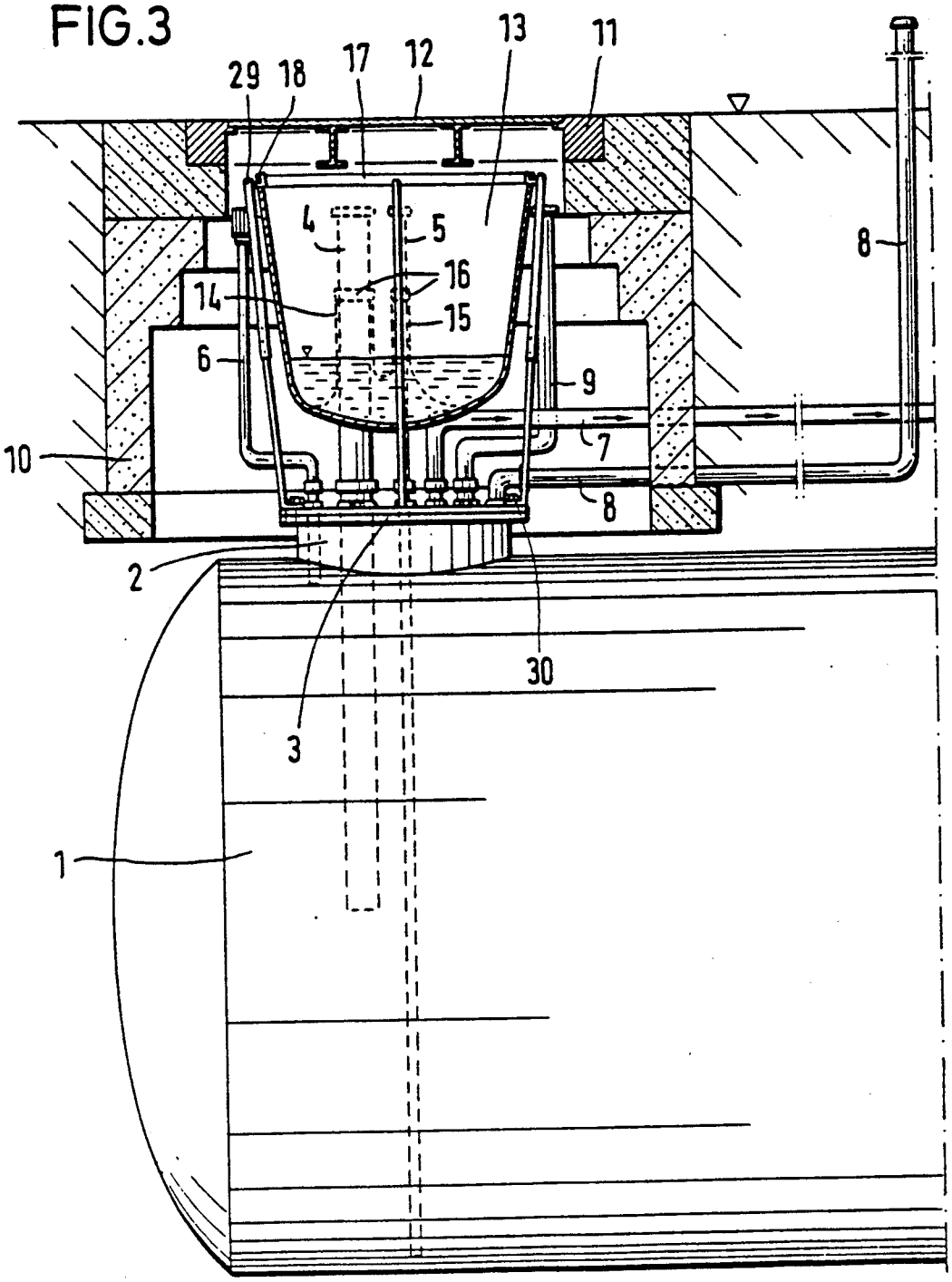
FIG. 3 is a vertical sectional view, similar to FIG. 1, with vertical rods for supporting the recovery bag with the rods fastened to the dome lid.

In FIG. 3, the supports 18 are located at the upper ends of telescopically adjustable vertical rods 29 for adjustment in the vertical and horizontal directions. The lower ends of the rods 29 are bent inwardly and fastened to the dome lid 3 by attachment screws 30. This arrangement eliminates attachments to the pit side walls.

Figure 4:
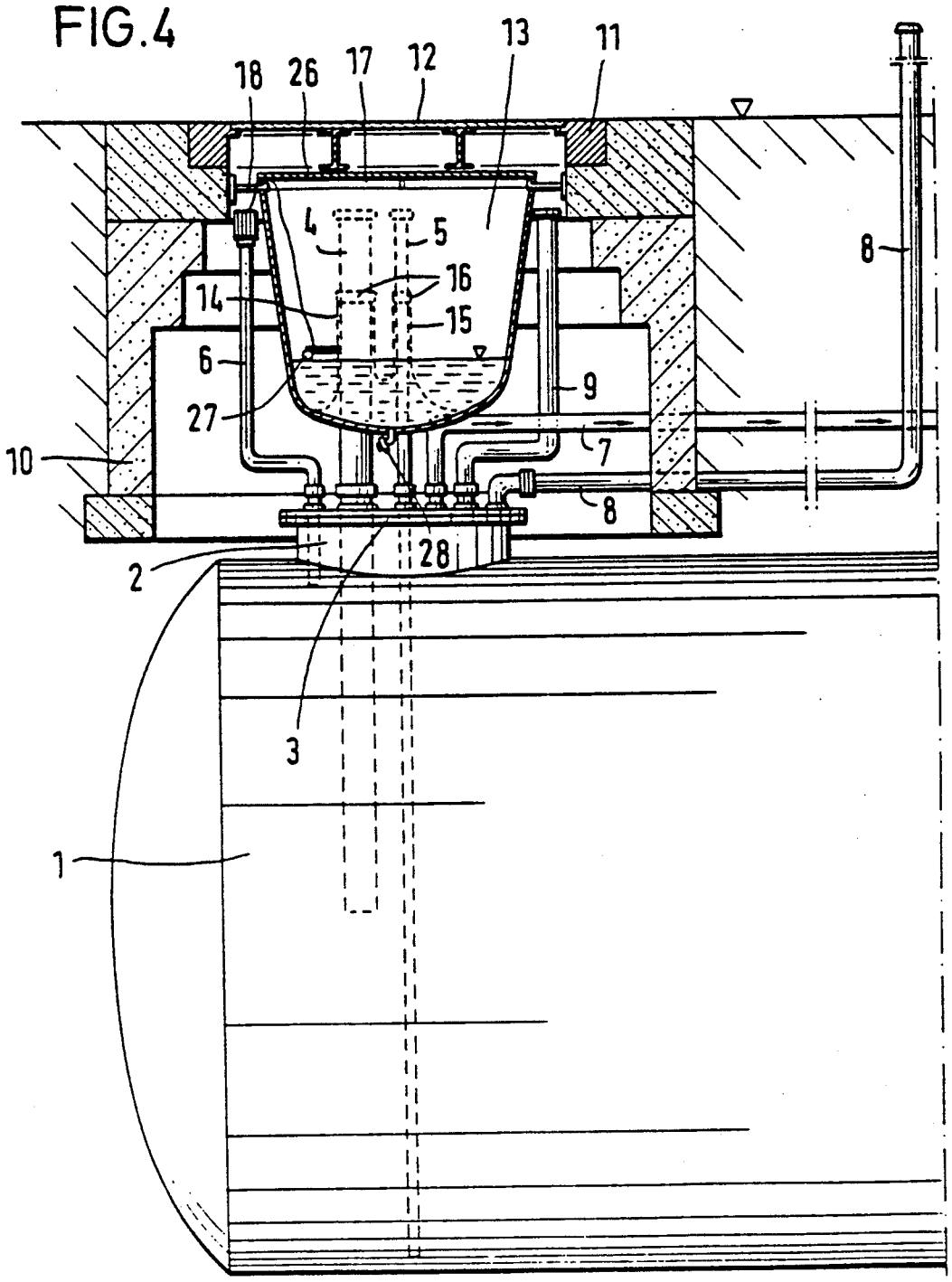
FIG. 4 is another vertical sectional view similar to FIG. 1 with a limit value transmitter located in the recovery bag and with an outlet at the lower end of the recovery bag.

In FIG. 4, the recovery bag 13 has an additional limit value transmitter 27 arranged in parallel with the limit value transmitter 6 in the tank, so that when a predetermined filling level is reached, overfilling of the recovery bag is prevented, especially if there is danger of overfilling due to insufficient tightness of the coupling between the filling pipe 4 and the filling hose connected with it.

In addition, an outlet with a simple drain faucet 28 is located at the lowermost end of the recovery bag, affording drainage of the bag in a variety of ways.

As can be seen in FIG. 4, recovery bag 13 is protected by a lid 26 against contamination or the penetration of rain water, which could enter the bag through apertures in the pit cover 12 if the lid 26 is not present.

Figure 5:
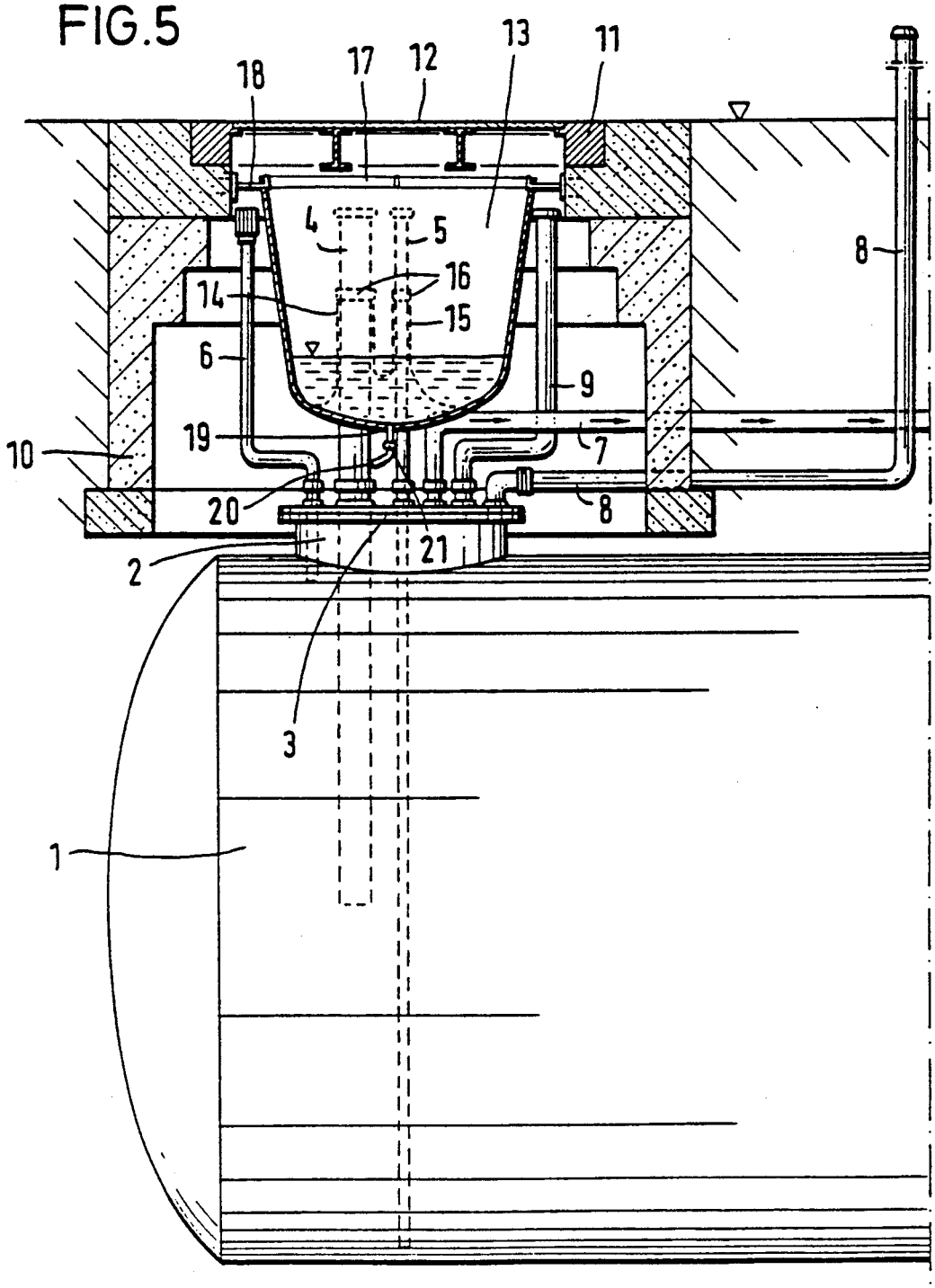
FIG. 5 is a vertical sectional view similar to FIG. 4 with an outlet discharging from the recovery bag into the filling pipe of the tank.

In FIG. 5 the outlet from the recovery bag 13 is in the form of a bypass 20 with a check valve 21 whereby the leakage is supplied continuously directly from the bag into the body of liquid in the storage tank 1.

Figure 6:
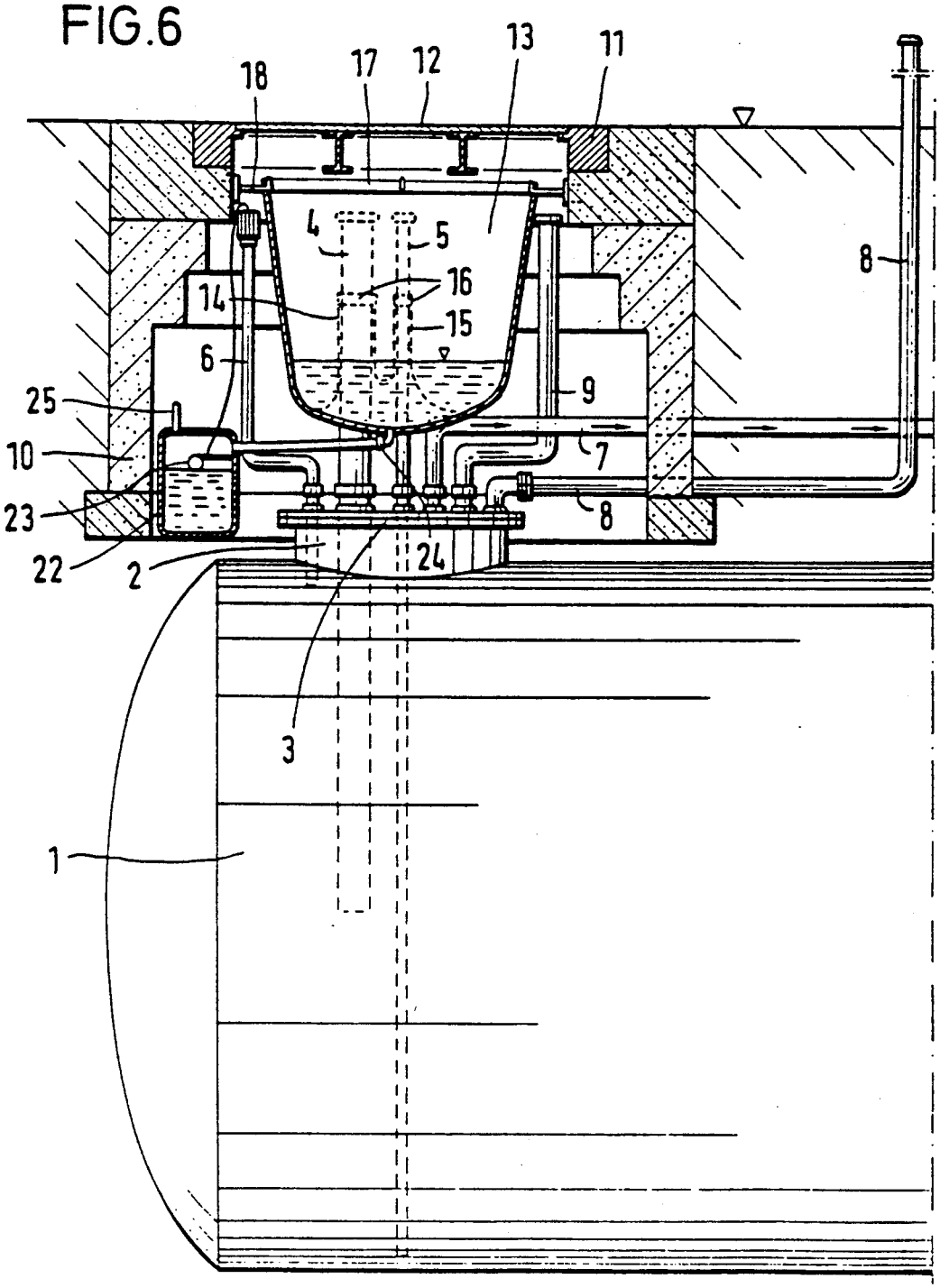
FIG. 6 is a vertical sectional view similar to FIGS. 4 and 5 with a separate waste disposal container connected to the recovery bag.

FIG. 6 shows a special waste disposal container 22 with a limit value transmitter 23. A check valve 24 is located in the outlet line between the recovery bag and the container 22. A vent duct 25 opens from the top of the container 22. The limit value transmitter 23 can be connected in parallel with the first limit value transmitter 6 in the tank 1.

The apparatus described above operates in the following manner.

To fill the fuel tank 1 a filling hose, not shown, stored in a transport vehicle, is connected to the filling pipe 4 with an appropriate coupling and the liquid fuel is filled into the tank 1 until the limit value indicator 6 interrupts its flow. Next, the coupling between the filling hose and the filling pipe is detached and unavoidable liquid leakage or spillage is received in the recovery bag 13 in such a manner that practically none of the liquid can reach the dome pit 10 and the ground below it by flowing over the upper edge 17 of the recovery bag 13. The effect on the recovery bag during an upward pull of a mechanical dip stick or during reinsertion of the dip stick in the stand pipe is similar, and, depending on the respective filling level, it can frequently occur that liquid spills over the upper end of the stand pipe. Such spillage liquid collects in the lower part of the recovery bag and, after reaching a predetermined filling level, can be pumped back through the filling pipe into the tank by a small hand pump available at a filling station. It is preferable to remove the liquid from the recovery bag 13 before it reaches the height of the packing 16 so that if the packing is not clamped to the stand pipe or the filling pipe in a completely tight manner, the liquid leakage can not escape from the recovery bag. Further, it can be noted that the liquid leakage can not spill over the upper attachment edge 17 of the recovery bag, since the upper ends of the filling pipe and the stand pipe are located below the attachment edge. As FIG. 2 indicates, the connections for the limit value transmitter 6 and the compensation line 9 can be shaped so that they are easily accessible in the corners of the pit after the pit cover 12 is removed. With the illustrated arrangement of the recovery bag 13, it is possible to lift the bag a certain distance and then move it sideways above the pit frame 11 without detaching the packing 16 from the filling pipe and the stand pipe, whereby the dome pit 10 is accessible for control and or repair.

Fabrication of the recovery bag 13 resistant to the liquid filled into the tank and formed in one piece with the packing formed out of the bottom of the bag is easily effected by conventional technology as has been known for a long time, for instance, as in a liquid-tight passage for several cables through cable packing, as shown in DE-PS 26 55 548.

The invention as described above can be changed in a variety of ways within the basic concept of the invention. As an example, the recovery bag 13 can be shaped other than circular in horizontal section, for use in rectangularly shaped dome pits, for instance, the bag can be shaped as a oval or similar shape. Moreover, the recovery bag of the present invention is suitable for other uses than with underground tanks for fuel and heating oil and other liquids where leakage into the ground is to be avoided.

While specific embodiments of the invention have been shown and described in detail to illustrate the application of the inventive principles, it will be understood that the invention may be embodied otherwise without departing from such principles.

I claim:

1. An apparatus for collecting liquid leakage where the liquid is supplied to an underground storage tank for fuel, heating oil and the like, comprising:

a tank having a dome lid;

a filling pipe extending through said dome lid into said tank, wherein said filling pipe is located in a dome pit extending upwardly from said dome lid, and wherein said dome pit has sidewalls;

a liquid leakage resistant flexible recovery bag laterally surrounding and secured to said filling pipe in a liquid tight manner, wherein said recovery bag is located within said dome pit between said dome lid and a pit cover closing an upper end of said dome pit above said dome lid, wherein said recovery bag is secured to said filling pipe with a packing located between said recovery bag and said filling pipe;

a clamping device securing said bag and the upper end of said packing to said filling pipe in a sealed manner with said packing extending downwardly from said clamping device toward a lower end of said recovery bag;

a standpipe arranged within said recovery bag and which extends downwardly therefrom into said tank wherein said standpipe is sealed with said recovery bag in the same manner as said filling pipe; and support elements, wherein said packing surrounds said filling pipe and said standpipe in a bellows-like manner, and further wherein said recovery bag has an upper edge located above upper ends of said filling pipe and said standpipe, wherein the upper edge of said recovery bag is supported by said support elements from said sidewalls of said dome pit in a spaced relation; and hooked shaped supports which support the upper edge of said recovery bag so that said recovery bag can be lifted upwardly with the movement of said packing and deposited on the outside of said dome pit.

2. An apparatus for collecting liquid leakage where the liquid is supplied to an underground storage tank for fuel, heating oil and the like, comprising:

a tank having a dome lid;

a filling pipe extending through said dome lid into said tank, wherein said filling pipe is located in a dome pit extending upwardly from said dome lid, and wherein said dome pit has sidewalls;

a liquid leakage resistant flexible recovery bag laterally surrounding and secured to said filling pipe in a liquid tight manner, wherein said recovery bag is located within said dome pit between said dome lid and a pit cover closing an upper end of said dome pit above said dome lid, wherein said recovery bag is secured to said filling pipe with a packing located between said recovery bag and said filling pipe;

a clamping device securing said bag and the upper end of said packing to said filling pipe in a sealed manner with said packing extending downwardly from said clamping device toward a lower end of said recovery bag;

a standpipe arranged within said recovery bag and which extends downwardly therefrom into said tank wherein said standpipe is sealed with said recovery bag in the same manner as said filling pipe; and support elements, wherein said packing surrounds said filling pipe and said standpipe in a bellows-like manner, and further wherein said recovery bag has an upper edge located above upper ends of said filling pipe and said standpipe, wherein the upper edge of said recovery bag is supported by said support elements from said sidewalls of said dome pit in a spaced relation; and hooked shaped supports which support the upper edge of said recovery bag so that said recovery bag can be lifted upwardly with the movement of said packing and deposited on the outside of said dome pit; and wherein said supports are mounted at upper ends of adjustable vertical rods with the lower ends of said vertical rods fastened to said dome lid.

3. An apparatus for collecting liquid leakage in an underground storage tank for fuel, heating oil and the like, said apparatus comprising:

a tank including a filling dome and a dome lid for closing said filling dome;

a dome pit located above said filling dome and having an open upper end and a lower end;

a pit cover for closing the upper end of said dome pit;

a pipe extending in said dome pit and through said dome lid into said tank for filling the same;

a flexible leakage-resistant recovery bag located within said dome pit between said dome lid and said pit cover and having an upper edge arranged in a speed relationship with respect to side walls of said dome pit, said recovery bag laterally surrounding said filling pipe and being secured thereto in a liquid tight manner, a leakage-resistant cover positioned at the top of said recovery bag; and outlet means located at the lower end of said recovery bag and communicating with said filling pipe for discharging the contents of said recovery bag into said filling pipe.

4. The apparatus of claim 3 further comprising a first limit value transmitter which is located in said recovery bag wherein liquid flowing through a filling hose which is connected to said filling pipe can be interrupted when a pre-determined liquid level in the recovery bag has been reached.

5. The apparatus of claim 4, wherein said first limit value transmitter is connected in parallel with a second limit value transmitter, wherein said second limit value transmitter is located within said tank for interrupting the flow of liquid into said tank when a pre-determined filling level has been reached.

6. The apparatus of claim 3 further comprising a standpipe which is arranged within said recovery bag and which extends downwardly therefrom into said tank and further wherein said standpipe is sealed with said recovery bag.

7. The apparatus of claim 6, wherein a check valve is located at said outlet means.

8. The apparatus of claim 3, wherein said recovery bag has an upper edge located above upper ends of said filling pipe and a standpipe.

9. The apparatus of claim 3, wherein said recovery bag has at least an inside surface layer which is resistant to the leakage of liquid.

10. The apparatus of claim 9, wherein said inside surface layer is formed of rubber.

11. The apparatus of claim 9 further comprising a reinforcement layer which is located at least one of within and on an outer surface of said inner surface layer.

12. The apparatus of claim 11, wherein said reinforcement layer includes fiberglass.

13. An apparatus for collecting liquid leakage in an underground storage tank for fuel, heating oil and the like, said apparatus comprising:

a tank including a filling dome and a dome lid for closing said filling dome;

a dome pit located above said filling dome and having an open upper end and a lower end;

a pit cover for closing the upper end of said dome pit;

a pipe extending in said dome pit and through said dome lid into said tank for filling the same;

a flexible leakage-resistant recovery bag located within said dome pit between said dome lid and said pit cover and having an upper edge arranged in a speed relationship with respect to side walls of said dome pit, said recovery bag laterally surrounding said filling pipe and being secured thereto in a liquid tight manner; and a leakage-resistant cover positioned at the top of said recovery bag.

14. The apparatus of claim 13, further comprising:

a waste disposal container;

an outlet means located at the lower end of said recovery bag for discharging the contents of said recovery bag into said waste disposal container; and a limit value transmitter located within said waste disposal container for indicating a filling level.

15. The apparatus of claim 13 further comprising supports which are mounted at upper ends of adjustable vertical rods wherein the lower ends of said vertical rods are fastened to said dome lid.

16. The apparatus of claim 15 wherein said supports provide support for the upper edge of said recovery bag so that said recovery bag can be lifted upwardly.

* * * * *